US005808454A

United States Patent [19]

Chung

[11] Patent Number: 5,808,454

[45] Date of Patent: Sep. 15, 1998

[54] ALTERNATING CURRENT POWER CONTROL DEVICE

[76] Inventor: Young Choon Chung, 101 Chungwa, 8-Woomeum-dong, Seocho-gu, Seoul, Rep. of Korea

[21] Appl. No.: 808,689

[22] Filed: Feb. 28, 1997

[51] Int. Cl.[6] ..... G05F 1/14

[52] U.S. Cl. ..... 323/255; 323/340

[58] Field of Search ..... 323/255, 258, 323/340, 343, 301

[56] References Cited

U.S. PATENT DOCUMENTS

| | | | |
|---|---|---|---|
| 4,623,834 | 11/1986 | Klingbiel et al. | 323/258 |
| 4,860,145 | 8/1989 | Klingbiel | 323/258 X |
| 5,628,202 | 5/1997 | Lee et al. | 323/258 X |

*Primary Examiner*—Peter S. Wong
*Assistant Examiner*—Y. J. Han
*Attorney, Agent, or Firm*—Jones, Tullar & Cooper, P.C.

[57] ABSTRACT

An alternating current power control device including a phase comparison controller for comparing a phase of an input voltage with that of a first reference voltage, a single-winding transformer for varying the input voltage, a mutual induction reactor for lowering the input voltage by a desired level in response to an output voltage from the single-winding transformer, an output voltage comparator for comparing an output voltage with a second reference voltage, an output current comparator for comparing an output current with a reference current, an OR logic controller for performing an OR operation with respect to output signals from the phase comparison controller and output current comparator, and a switch array for selectively transferring the output voltage from the single-winding transformer to the mutual induction reactor in response to output signals from the output voltage comparator and OR logic controller. According to the present invention, the mutual induction reactor is implemented on the basis of the principle of a linear transformer and has a small capacity corresponding to about 1/10 of a load power. Therefore, a proper power necessary to the saving of energy can be supplied by using the mutual induction reactor.

4 Claims, 4 Drawing Sheets

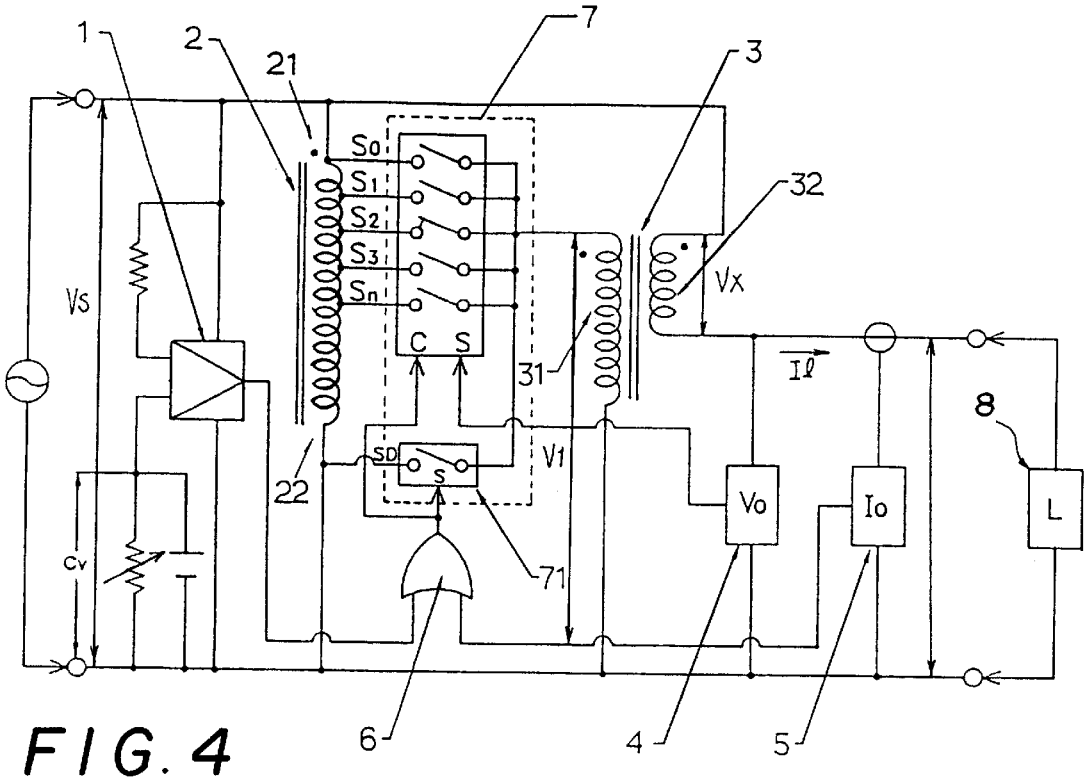
FIG. 4
FIG. 5
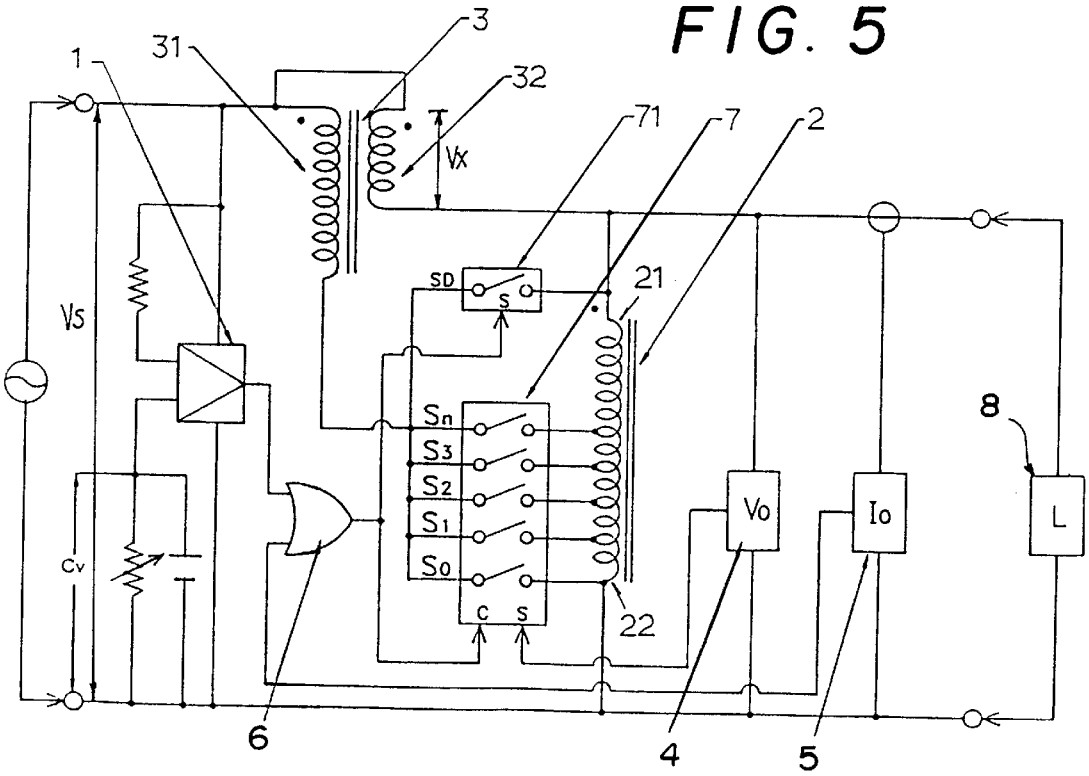

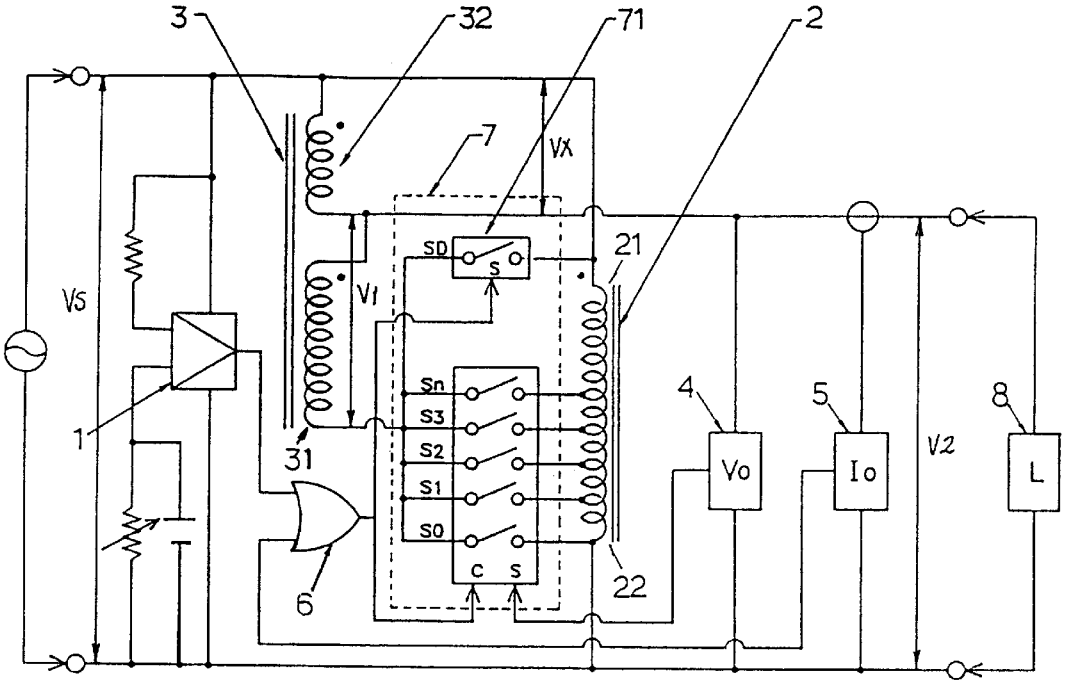
FIG. 6
FIG. 7(A)
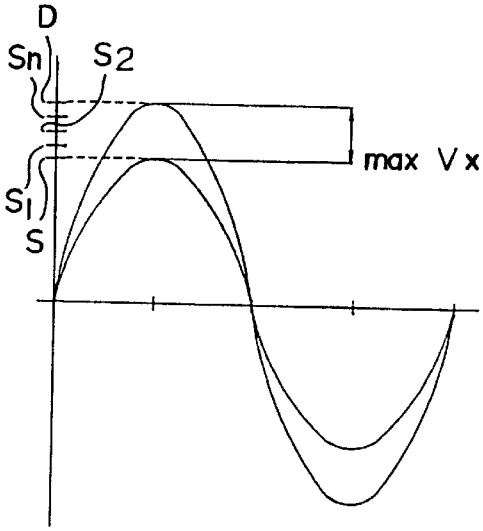
FIG. 7(B)
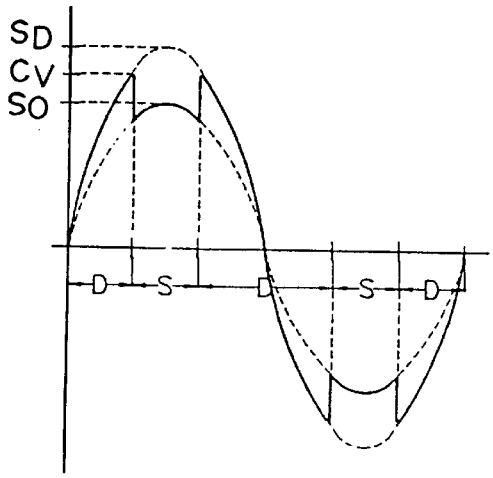

ALTERNATING CURRENT POWER CONTROL DEVICE

BACKGROUND OF THE INVENTION

1. Field of the Invention

The present invention relates in general to alternating current (AC) power control devices of the linear type employing electromagnetic transformation means such as a transformer, and more particularly to an AC power control device having a constant voltage function for maintaining a constant output voltage although an input voltage is varied, if a desired voltage is set with respect to a load.

2. Description of the Prior Art

Generally, in electric home appliances, a voltage lowered to about 10 to 20% of a rated voltage is often used to sufficiently drive a load effectively. In this connection, a power saving device has been required to obtain a power saving effect by initially supplying power lowered to a desired level to a load.

The power saving device is embodied to save money on electric charges, thus improving economic gains. To this end, the power saving device must be low in manufacturing cost in view of economy and secure absolute reliability. Further, the power saving device must not exert a bad effect such as electromagnetic interference on a load system. In general, AC power control devices which can be used as such a power saving device with the voltage down function are classified into the linear type employing a single-winding transformer (autotransformer), a multi-winding transformer, a reactor, etc. and the phase or pulse width modulation (PWM) control type employing a switching semiconductor element. However, the power control device of the general transformer type is very large in volume and weight, resulting in a degradation in practical use. The power control device of the electronic circuit switching control type cannot satisfy electrical reliability and economy and may cause an electric noise such as EMI, adversely affecting the surrounding electric environment.

On the other hand, a constant voltage control device using a transformer is shown in U.K. Patent No. GB2043971. The constant voltage control device employs a method of switching a polarity of a primary coil of the transformer, the secondary coil of which is connected in series to a load. However, the constant voltage control device cannot perform a fine constant voltage control operation. Further, the constant voltage control device does not comprise a closed circuit capable of absorbing a magnetic induction high voltage produced in a switching transition period. As a result, it is difficult to use a mechanical contact switch or a semiconductor switch, resulting in a degradation in practical use. Moreover, in the constant voltage control device, a counter electromotive voltage is generated at a switching moment, thereby causing an electromagnetic noise to be provided to various electronic products such as a computer, audio, television, etc., connected to the device output. For this reason, the constant voltage control device is limited in use with respect to electronic products, or loads other than electric loads such as a motor, heater, etc.

SUMMARY OF THE INVENTION

Therefore, the present invention has been made in view of the above problems, and it is an object of the present invention to provide a power-saving linear power control device in which voltage down means is provided with a mutual induction reactor acting as a kind of single or multi-winding transformer and having a power capacity considerably smaller than that of a load, to linearly lower a large capacity of load voltage, automatic voltage control means is provided to maintain a constant output voltage when an input voltage is higher or lower than a reference voltage, and bypass means is operated according to states of the load and input voltage to bypass the input voltage directly to the load when the input voltage is lower than or equal to a voltage desired by the load, so that EMI or switching noise is eliminated. It is another object of the present invention to provide a method for controlling an output voltage using a parallel or series- winding mutual induction reactor.

The present invention has been made on the basis of the fact that a load can normally be driven even if an input voltage is lowered to about 10–20% of a rated voltage in an AC impedance load system including no direct current (DC) resistance load component such as a heater. Voltage down means is provided to lower the input voltage to within the desired range and supply the lowered voltage to the load system, so as to have the power saving effect. Furthermore, a constant voltage function is provided to stabilize a variation of the input voltage. Therefore, the present invention provides an economical device capable of simultaneously satisfying the power saving effect, power supply stability and reliability.

In accordance with the present invention, the above and other objects can be accomplished by a provision of an alternating current power control device comprising a phase comparison controller for comparing a phase of an input voltage with that of first reference voltage; a single-winding transformer for varying the input voltage; a mutual induction reactor for lowering the input voltage by a desired level in response to an output voltage from the single-winding transformer; an output voltage comparator for comparing an output voltage with a second reference voltage; an output current comparator for comparing an output current with a reference current; an OR logic controller for performing an OR operation with respect to output signals from the phase comparison controller and output current comparator; and a switch array for selectively transferring the output voltage from the single-winding transformer to the mutual induction reactor in response to output signals from the output voltage comparator and OR logic controller.

BRIEF DESCRIPTION OF THE DRAWINGS

The above and other objects, features and advantages of the present invention will be more clearly understood from the following detailed description taken in conjunction with the accompanying drawings, in which:

FIGS. 4 to 6 are detailed circuit diagrams of the AC power control devices in FIGS. 1 to 3, respectively; and FIG. 7A is a waveform diagram of a linear-controlled output voltage; and FIG. 7B is a waveform diagram of a phase-controlled output voltage.

DETAILED DESCRIPTION OF THE PREFERRED EMBODIMENTS

Figure 1:
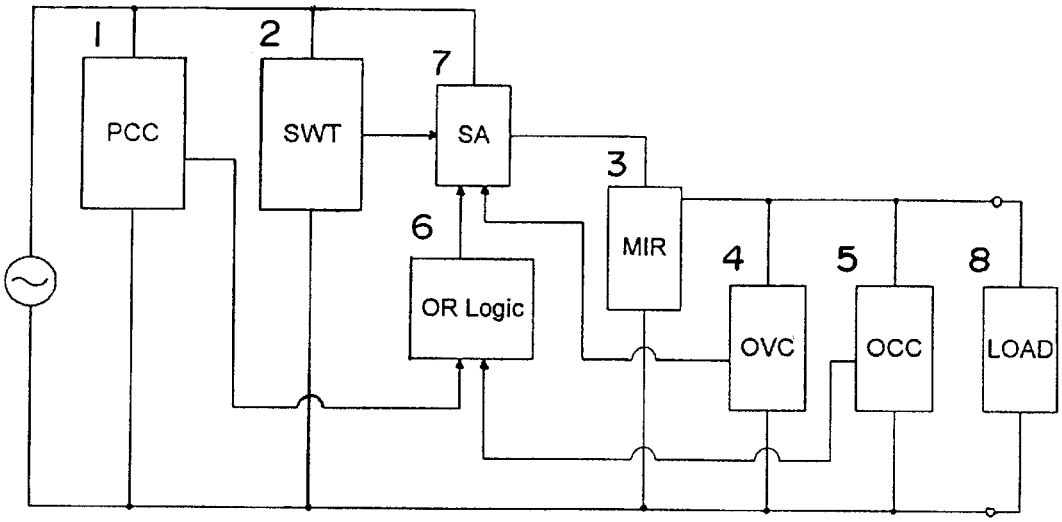
FIGS. 1 to 3 are block diagrams illustrating the constructions of AC power control devices in accordance with first to third embodiments of the present invention, respectively.

FIG. 1 is a block diagram illustrating the construction of an AC power control device in accordance with a first embodiment of the present invention and FIG. 4 is a detailed circuit diagram of the AC power control device in FIG. 1. As shown in these drawings, the AC power control device comprises a single-winding transformer 2 for varying an input voltage, and a mutual induction reactor 3 for lowering the input voltage by a desired level in response to an output voltage from the single-winding transformer 2. The mutual induction reactor 3 includes a primary voltage coil 31 having its one side (winding start point) connected to an output of the single-winding transformer 2 and its other side (winding end point) connected to a power ground line. Namely, the mutual induction reactor 3 is connected in parallel to the output of the single-winding transformer 2.

The mutual induction reactor 3 further includes a secondary current coil 32 having its one side (winding start point) connected to a power supply line and its other side (winding end point) connected to a load 8. The secondary current coil 32 is designed to allow a rated current to sufficiently flow to the load 8, and to generate a voltage Vx lower than or equal to 20% of an input voltage Vs.

The single-winding transformer 2 may typically include a variable tap. However, in the preferred embodiment of the present invention, the single-winding transformer 2 includes a plurality of fixed taps provided from its winding start point to its winding middle point. A switch array 7 selectively connects the winding start point of the primary voltage coil 31 of the mutual induction reactor 3 to the fixed taps of the single-winding transformer 2. To this end, the switch array 7 includes a plurality of switches S0–Sn, each of which has a fixed terminal connected to a corresponding one of the fixed taps of the single-winding transformer 2 and a movable terminal connected to a common output terminal of the switch array 7. The common output terminal of the switch array 7 is connected to one side of the primary voltage coil 31 of the mutual induction reactor 3, the other side of which is connected to the power ground line. The switch array 7 further includes a bypass switch SD 71 having a fixed terminal connected to a winding end point of the single-winding transformer 2 and a movable terminal connected to the common output terminal of the switch array 7. Preferably, the switches in the switch array 7 may be provided with relays or triacs, respectively.

The secondary current coil 32 of the mutual induction reactor 3 is connected in series to the load 8. An output voltage V2 to the load 8 can be expressed as follows:

$$V2=Vs-Vx$$

where, Vs is the input voltage and Vx is the voltage of the secondary current coil 32 of the mutual induction reactor 3.

Preferably, the secondary current coil 32 of the mutual induction reactor 3 generates the voltage Vx lower than or equal to 20% of the input voltage Vs, to reduce the input voltage Vs by 20% at the maximum. More preferably, the secondary current coil 32 lowers the input voltage Vs by 10% and supplies the lowered voltage to the load 8. To this end, the secondary current coil 32 of the mutual induction reactor 3 has the number of turns corresponding to 10% of the input voltage Vs and is wound in phase with the primary voltage coil 31 of the mutual induction reactor 3. The mutual induction reactor 3 has a capacity which is determined by multiplying current IL to the load 8 by the voltage Vx of the secondary current coil 32. As a result, the mutual induction reactor 3 can be satisfied with such a small capacity which is about 1/10 of that of the load 8. The voltage Vx of the secondary current coil 32 is determined by a turn ratio of the primary voltage coil 31 to secondary current coil 32 and a voltage V1 of the primary voltage coil 31. In this connection, the input voltage Vs is reduced by the voltage Vx of the secondary current coil 32 based on the voltage V1 of the primary voltage coil 31 and then applied to the load 8. Therefore, the power can be reduced by Vx X IL.

A phase comparison controller 1 is adapted to compare a phase of the input voltage Vs with that of a reference voltage CV. To this end, the phase comparison controller 1 has its one input connected to the power supply line and its other input connected to a reference voltage source. Preferably, the reference voltage source may be a variable resistor. An OR logic controller 6 has its one input connected to an output of the phase comparison controller 1 and its other input connected to an output of an output current comparator 5 which performs a comparison operation with respect to the current IL to the load 8. The OR logic controller 6 also has its output connected in common to a control input terminal S of the bypass switch 71 in the switch array 7 and to a control input terminal C of the switch array 7 which turns off all the switches S0–Sn in the switch array 7. An output voltage comparator 4 performs a comparison operation with respect to the output voltage V2 to the load 8. To this end, the output voltage comparator 4 has its input connected in parallel to an output of the mutual induction reactor 3 and its output connected to a switch selection control input terminal S of the switch array 7.

Upon the application of power, the phase comparison controller 1 compares the phase of the input voltage Vs with that of the reference voltage CV and outputs a high or low level signal H or L in accordance with the compared result. For example, if the input voltage Vs is lower than the reference voltage CV, the phase comparison controller 1 outputs the high level signal which is then applied through the OR logic controller 6 to the control input terminal S of the bypass switch 71 and to the control input terminal C of the switch array 7. As a result, the bypass switch 71 is turned on and all the switches S0–Sn in the switch array 7 are turned off. As the bypass switch 71 is turned on, the. winding start point of the primary voltage coil 31 of the mutual induction reactor 3 is connected to the lowermost tap 22 of the single-winding transformer 2, so that a short-circuit can be formed. Because of the formation of short-circuit, a magnetic flux of the mutual induction reactor 3 is neutralized and the secondary current coil 32 of the mutual induction reactor 3 is changed into a conductor. As a result, the input voltage Vs is supplied directly to the load 8. On the other hand, in the case where the input voltage Vs is higher than the reference voltage CV, the phase comparison controller 1 outputs the low level signal, thereby causing the bypass switch 71 to be turned off. Also, any one of the switches S0–Sn in the switch array 7 is turned on in response to an output signal from the output voltage comparator 4. As a result, the primary voltage coil 31 of the mutual induction reactor 3 is excited in response to an output voltage from the turned-on switch in the switch array 7, thereby causing the voltage Vx to be induced in the secondary current coil 32 of the mutual induction reactor 3. In result, the output voltage V2 obtained by lowering the input voltage Vs by the voltage Vx of the secondary current coil 32 is supplied to the load 8.

FIG. 7A is a waveform diagram of a linear-controlled output voltage in accordance with the present invention and FIG. 7B is a waveform diagram of a phase-controlled output voltage in accordance with the present invention. An AC phase-controlled output voltage as shown in FIG. 7B can be obtained from the operation of the phase comparison controller 1 based on the reference voltage CV. The average phase-controlled output voltage is adjusted at a ratio of a direct bypass time D to a voltage down time S. If the input voltage Vs becomes higher than a reference voltage of the output voltage comparator 4, the output voltage comparator 4 outputs a desired signal to the switch selection control input terminal S of the switch array 7 to turn on a desired one of the switches S0–Sn in the switch array 7, so as to select an upper one of the fixed taps of the single-winding transformer 2. As a result, the voltage Vx of the secondary current coil 32 of the mutual induction reactor 3 is raised so that the output voltage V2 can be maintained constantly. Such a linear-controlled output voltage is shown in FIG. 7A. On the other hand, in the case where the load current IL is larger in amount than a reference current of the output current comparator 5, the output current comparator 5 outputs a desired signal to the OR logic controller 6 to turn on the bypass switch 71 and turn off all the switches S0–Sn in the switch array 7. As a result, in the case where much load current is required, such as, for example, the start of a motor, the input voltage Vs is bypassed at once to sufficiently supply power to the load 8.

Then, if the load current is returned to the normal state, the bypass switch 71 is turned off and any one of the switches S0–Sn in the switch array 7 is turned on for the power saving mode.

If the winding start point of the primary voltage coil 31 of the mutual induction reactor 3 is connected to the uppermost tap 21 of the single-winding transformer 2, the voltage Vx of the secondary current coil 32 of the mutual induction reactor 3 becomes the maximum, thereby causing the saved power amount to become the maximum. In the case where the winding start point of the primary voltage coil 31 of the mutual induction reactor 3 is connected to the middle tap of the single-winding transformer 2 through the switch (for example, S3) in the switch array 7, the voltage V1 of the primary voltage coil 31 is reduced. As a result, the voltage Vx of the secondary current coil 32 of the mutual induction reactor 3 is reduced, thereby causing the saved power amount to be reduced. In this manner, as the input voltage Vs becomes higher in level, the winding start point of the primary voltage coil 31 of the mutual induction reactor 3 is moved toward the uppermost tap 21 of the single-winding transformer 2 to maintain the output voltage V2 constantly. On the other hand, in the case where a high voltage is required to be supplied to the load 8, such as the start of a motor or the lighting of a discharge lamp, the winding start point of the primary voltage coil 31 of the mutual induction reactor 3 is connected to the lowermost tap 22 of the single-winding transformer 2 through the bypass switch 71, so that a short-circuit can be formed. Because of the formation of short-circuit, a magnetic flux of the mutual induction reactor 3 is neutralized and the secondary current coil 32 of the mutual induction reactor 3 is changed into a conductor, resulting in the flow of much current. As a result, the input voltage Vs can be supplied directly to the load 8 with no use of a separate bypass switch. In other words, there is no necessity for connecting a separate large capacity current switch across the secondary current coil 32 of the mutual induction reactor 3. Also, a transient phenomenon such as a high surge can be minimized even in the linear voltage variation or tap switching of the primary voltage coil 31 of the mutual induction reactor 3 because the parallel circuit of the single-winding transformer 2 constitutes a closed circuit.

Figure 2:
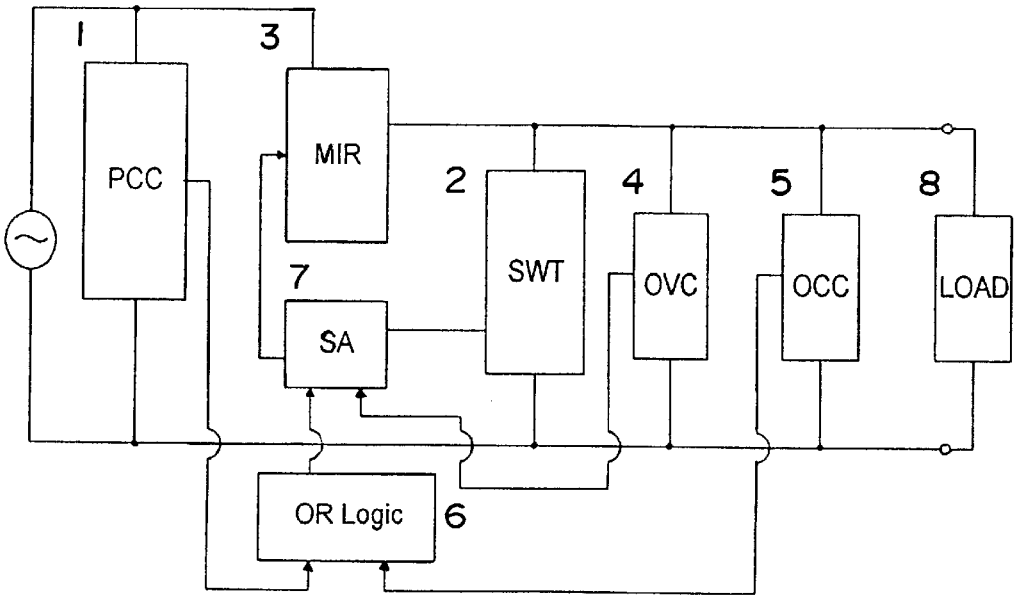

FIG. 2 is a block diagram illustrating the construction of an AC power control device in accordance with a second embodiment of the present invention and FIG. 5 is a detailed circuit diagram of the AC power control device in FIG. 2. In these drawings, the output voltage V2 is used to excite the primary voltage coil 31 of the mutual induction reactor 3. The winding start points of the primary voltage coil 31 and secondary current coil 32 of the mutual induction reactor 3 are connected in common to the power supply line. The winding end point of the secondary current coil 32 of the mutual induction reactor 3 is connected in series to the load 8. The single-winding transformer 2 is connected in parallel to the output of the mutual induction reactor 3. In the second embodiment of the present invention, the single-winding transformer 2 includes a plurality of fixed taps provided from its winding middle point to its winding end point. The fixed taps of the single-winding transformer 2 are selectively connected to the winding end point of the primary voltage coil 31 of the mutual induction reactor 3 through the switches S0–Sn in the switch array 7.

If the input voltage Vs becomes higher in level, the winding end point of the primary voltage coil 31 of the mutual induction reactor 3 is moved toward the lowermost tap 22 of the single-winding transformer 2, thereby causing the voltage Vx of the secondary current coil 32 of the mutual induction reactor 3 to become the maximum. As a result, the output voltage V2 becomes the minimum. On the other hand, in the case where the input voltage Vs becomes lower in level, the winding end point of the primary voltage coil 31 of the mutual induction reactor 3 is moved toward the uppermost tap 21 of the single-winding transformer 2 and ultimately connected thereto. In this case, the primary voltage coil 31 and secondary current coil 32 of the mutual induction reactor 3 are connected in parallel to each other and the magnetic flux of the mutual induction reactor 3 is neutralized. As a result, the input voltage Vs is 100% supplied to the load 8.

Figure 3:
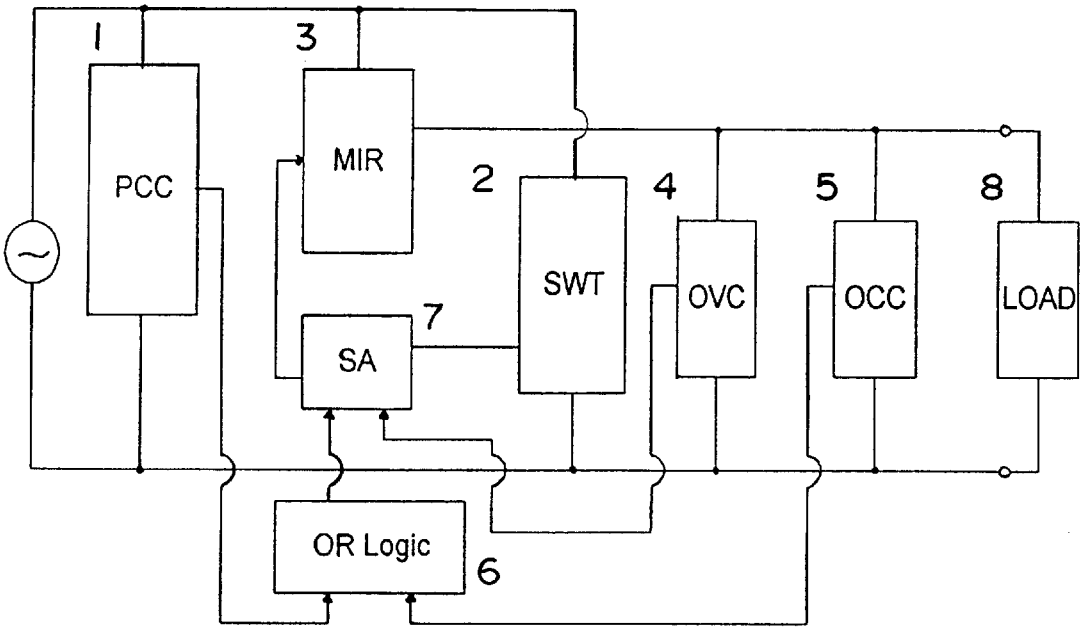

FIG. 3 is a block diagram illustrating the construction of an AC power control device in accordance with a third embodiment of the present invention and FIG. 6 is a detailed circuit diagram of the AC power control device in FIG. 3. In these drawings, the mutual induction reactor 3 is of the series-winding type where the primary voltage coil 31 is excited to control the voltage Vx of the secondary current coil 32. The winding start point of the secondary current coil 32 of the mutual induction reactor 3 and the uppermost tap 21 of the single-winding transformer 2 are connected in parallel to the power supply line. The winding end point of the secondary current coil 32 of the mutual induction reactor 3 is connected in parallel to the winding start point of the primary voltage coil 31 of the mutual induction reactor 3 and the load 8. The lowermost tap 22 of the single-winding transformer 2 is connected to the power ground line.

As the input voltage Vs becomes higher in level, the winding end point of the primary voltage coil 31 of the mutual induction reactor 3 is moved toward the lowermost tap 22 of the single-winding transformer 2, thereby causing the voltage Vx of the secondary current coil 32 of the mutual induction reactor 3 to become the maximum. As a result, the output voltage V2 becomes the minimum.

On the other hand, in the case where the input voltage Vs becomes lower in level, the winding end point of the primary voltage coil 31 of the mutual induction reactor 3 is moved toward the uppermost tap 21 of the single-winding transformer 2 to compensate for a voltage drop. Furthermore, as the input voltage Vs falls below the reference voltage CV, the winding end point of the primary voltage coil 31 of the mutual induction reactor 3 is ultimately connected to the uppermost tap 21 of the single-winding transformer 2. In this case, the primary voltage coil 31 and secondary current coil 32 of the mutual induction reactor 3 are connected in parallel to each other and the magnetic flux of the mutual induction reactor 3 is neutralized. As a result, the input voltage Vs is 100% supplied to the load 8.

As apparent from the above description, the proper power necessary to the saving of energy can be supplied by using the mutual induction reactor which is implemented on the basis of the principle of the linear transformer and has the small capacity corresponding to about 1/10 of the load power. Further, the linear voltage control as shown in FIG. 7A and the dual phase switching control as shown in FIG. 7B are implemented to provide the desired average AC voltage and minimize noise and surge current in the switching transient period. Therefore, the present invention provides the power-saving AC power control device which is economical, compact, light and highly reliable.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An alternating current power control device comprising:

an phase comparison controller for comparing a phase of an input voltage with that of a first reference voltage;

a single-winding transformer for varying said input voltage;

a mutual induction reactor for lowering said input voltage by a desired level in response to an output voltage from said single-winding transformer;

an output voltage comparator for comparing an output voltage from said mutual induction reactor with a second reference voltage;

an output current comparator for comparing an output current from said mutual induction reactor with a reference current;

an OR logic controller for performing an OR operation with respect to output signals from said phase comparison controller and output current comparator; and a switch array for selectively transferring said output voltage from said single-winding transformer to said mutual induction reactor in response to output signals from said output voltage comparator and OR logic controller.

2. An alternating current power control device as set forth in claim 1, wherein said single-winding transformer includes its winding start point connected to a power supply line, its winding end point connected to a power ground line and a plurality of fixed taps provided between said winding start point and winding end point, said mutual induction reactor includes a primary voltage coil having its winding start point selectively connected to said fixed taps of said single-winding transformer through said switch array and its winding end point connected to said power ground line and a secondary current coil having its winding start point connected to said power supply line and its winding end point connected to a load, and said switch array includes a bypass control input terminal and a release input terminal for commonly inputting said output signal from said OR logic controller and a switch selection control input terminal for inputting said output signal from said output voltage controller.

3. An alternating current power control device as set forth in claim 1, wherein said single-winding transformer includes its winding start point connected to a load, its winding end point connected to a power ground line and a plurality of fixed taps provided between said winding start point and winding end point, said mutual induction reactor includes a primary voltage coil having its winding start point connected to a power supply line and its winding end point selectively connected to said fixed taps of said single-winding transformer through said switch array and a secondary current coil having its winding start point connected to said power supply line and its winding end point connected to said load, and said switch array includes a bypass control input terminal and a release input terminal for commonly inputting said output signal from said OR logic controller and a switch selection control input terminal for inputting said output signal from said output voltage controller.

4. An alternating current power control device as set forth in claim 1, wherein said single-winding transformer includes its winding start point connected to a power supply line, its winding end point connected to a power ground line and a plurality of fixed taps provided between said winding start point and winding end point, said mutual induction reactor includes a primary voltage coil having its winding start point connected to a load and its winding end point selectively connected to said fixed taps of said single-winding transformer through said switch array and a secondary current coil having its winding start point connected to said power supply line and its winding end point connected to said winding start point of said primary voltage coil, and said switch array includes a bypass control input terminal and a release input terminal for commonly inputting said output signal from said OR logic controller and a switch selection control input terminal for inputting said output signal from said output voltage controller.

* * * * *